US006312087B1

(12) United States Patent
Imai et al.

(10) Patent No.: US 6,312,087 B1
(45) Date of Patent: Nov. 6, 2001

(54) SYSTEM FOR PURGING AN INK JET RECORDER

(75) Inventors: Koji Imai; Hirotake Nakamura, both of Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 09/053,758

(22) Filed: Apr. 2, 1998

(30) Foreign Application Priority Data

Apr. 3, 1997 (JP) ..... 9-085367
Jun. 10, 1997 (JP) ..... 9-152398

(51) Int. Cl.[7] ..... B41J 2/165
(52) U.S. Cl. ..... 347/23
(58) Field of Search ..... 347/23, 29, 30, 347/35

(56) References Cited

U.S. PATENT DOCUMENTS 5,298,923 * 3/1994 Tokunaga et al. ..... 347/30
5,410,341 4/1995 Sugahara et al. ..... 347/69
5,455,608 * 10/1995 Stewart et al. ..... 347/23
5,502,472 3/1996 Suzuki ..... 347/69
5,701,146 * 12/1997 Akiyama et al. ..... 347/26
5,757,396 * 5/1998 Bruner ..... 347/27
5,805,180 * 9/1998 Ebisawa et al. ..... 347/23
5,870,126 * 2/1999 Kondo et al. ..... 347/92
5,900,889 * 5/1999 Tsukuda ..... 347/23

* cited by examiner

*Primary Examiner*—Judy Nguyen
(74) *Attorney, Agent, or Firm*—Oliff & Berridge, PLC

(57) ABSTRACT

An ink jet recorder includes a recording head having an actuator for ejecting ink from a nozzle by changing the volume of an ink passage, an ink cartridge, a purging device, and a control unit. The control unit controls the purging device so as to effect a first purge and a second purge having a greater sucking force than that in the first purge, and controls the actuator during the first purging operation. Ink passage walls and ink are vibrated, and by virtue of a synergistic effect with the flow of ink flowing due to the first purging operation, bubbles and foreign objects attached to the passage walls are easily separated from the walls. The operation of the actuator can be executed by lagging behind a purging start for a predetermined time duration.

23 Claims, 11 Drawing Sheets

SYSTEM FOR PURGING AN INK JET RECORDER

BACKGROUND OF THE INVENTION

1. Field of the Invention

The present invention relates to an ink jet recorder having a purging device, and more particularly to an ink jet recorder having a purging device which is capable of effectively removing bubbles and foreign objects attached to wall surfaces of ink passages of a recording head.

2. Description of the Related Art

Generally, an ink jet printer, for example, is known as an ink jet recording apparatus for effecting recording such as printing by ejecting ink onto a recording medium such as paper.

In the ink jet printer, as shown in FIG. 11, an ink cartridge P1 in which ink is accommodated is replaceably mounted on a recording head unit P3 having a recording head P2. Ink is supplied from the replaced ink cartridge P1 to the recording head P2, and is ejected through ejection nozzles P4 so as to effect recording.

Further, such as in the course of using the ink jet printer, a so-called purging operation in which the ink is sucked from distal end sides of the ejection nozzles P4, i.e., from nozzle faces P5 where ejection holes (not shown) are open, is performed by the manual operation of a switch by a user or automatically when a predetermined condition has been met.

The purging operation is an operation in which a suction cap P6 is applied to the nozzle face P5, and negative pressure is applied to the interior of the suction cap P6 by a suction pump (not shown), thereby sucking the ink from inside the recording head P2 through the suction cap P6 and removing the same to outside.

However, there have been cases where very small bubbles and dust remaining inside ink passages cannot be removed sufficiently by only the purging operation based on the suction which makes use of the aforementioned negative pressure.

Namely, there has been a problem in that although very small bubbles and dust are sometimes attached to inner peripheral surfaces (wall surfaces) of unillustrated channels and a manifold for forming ink passages, since the closer to the wall surface, the slower the velocity of flow of the ink, it is difficult to remove the bubbles and dust attached to the wall surfaces even if flow of ink is produced by executing a purge.

If the bubbles and dust remain in the passages of the ink, there have been cases where ejection is hampered during the ejection of the ink, resulting in a decline in the recording quality.

Accordingly, as disclosed in Japanese Patent Application No. 295267/1988 and in its corresponding U.S. Pat. No. 5,298,923, a technique has been proposed in which the printing head is driven in synchronism with the suction of the ink in the purging operation. According to this technique, the ink in the ink passages is vibrated by driving the printing head, and very small dust and bubbles which are attached to the inner wall surfaces of the inner wall surfaces of the ink passages and which could not be removed by suction alone are also exfoliated smoothly and are easily removed by the vibration of the ink.

However, this publication fails to disclose the execution of the operation of the actuators of the print head after the lapse of a predetermined time duration from the start of the purging operation as in the present invention.

When a user has loaded an ink cartridge in a new printer for the first time in the use of the ink jet printer, the ink passages are filled with air. In addition, when the ink cartridge has been replaced, air is present between the ink cartridge and the print head. Further, after making a misjudgment that ejection is impossible when the remaining amount of ink has become small, the user might effect a purging operation to recover the ejecting function. If the user does so, there occurs a state in which the print head is emptied of the ink and the ink passages are filled with air.

If the ink is abruptly sucked by applying a large negative pressure at a stroke when filling the ink passages with the ink by performing a purging operation in the above-described state, the ink and air become mixed and flow into the print head, so that bubbling occurs in the ink, and the bubbles are entrained in the ink inside the print head. In particular, in a case where filter members are provided to prevent dust and the like from moving toward the print head together with the ink, when the ink abruptly passes through the filter members, large-scale bubbling occurs, and bubbles are produced in a large amount.

Thus, in the state in which a mixture of ink and air has abruptly flowed into the print head, if the print head is driven in synchronism with the suction of the ink as in the technique disclosed in the aforementioned publication, the bubbling of the ink is further prompted. As a result, the ejection of the ink is hampered appreciably, and it becomes impossible to effect normal printing.

SUMMARY OF THE INVENTION

Accordingly, it is an object of the present invention to provide an ink jet recording apparatus which is capable of effectively removing bubbles and foreign objects attached to wall surfaces of ink passages of a recording head.

Another object of the present invention is to provide an ink jet recording apparatus which is capable of a purging operation which makes it possible to allow ink to be introduced into the recording head while suppressing the bubbling of the ink even in a case where air is present in ink passages of the recording head.

In accordance with a first aspect of the present invention, there is provided an ink jet recorder comprising: a recording head having an ink passage, a nozzle connected thereto, and an actuator for ejecting ink from the nozzle by changing a volume of the ink passage; a purging device for covering the nozzle and sucking the ink inside the recording head; and a control unit for controlling the actuator such that the actuator is operated after the lapse of a predetermined time duration from a start of purge by the purging device.

In the ink jet recorder in accordance with the first aspect of the present invention, the actuator is activated after the lapse of a predetermined time duration after the start of purge, i.e., when the flow of the ink sucked by the purging device is taking place in the ink passage. Very small bubbles and foreign objects which remained attached to the walls of the passages are removed from the walls due to the vibration of the walls of the ink passages or cavitation based on the vibration through the operation of the actuator, and are discharged outside the recording head together with the flowing ink. As a result, it is possible to improve the recording quality.

To remove the bubbles in the ink passage, it has been found that it is effective to perform the operation of the actuator when the ink inside the ink passage has actually started to flow. Namely, by vibrating the ink passage when the ink is flowing at a predetermined flow rate, the separation of the bubbles from the wall is prompted. For this reason, the predetermined time duration can be set to one at least from the start of purge until the flow of the ink inside the ink passage is started.

The ink jet recorder in accordance with the present invention further comprises: an ink cartridge; and a sensor for detecting replacement of the ink cartridge, wherein the control unit is capable of operating the purging device in response to a signal representing detection of the replacement of the ink cartridge by the sensor, and of operating the actuator after the lapse of a predetermined time duration from the start of purge by the purging device. The bubbles in the ink passage are liable to occur due to the replacement of the ink cartridge. Accordingly, in the ink jet recorder of the type in which the ink cartridge is replaced, the replacement of the ink cartridge is automatically detected by the sensor, and the purge is executed on the basis of the signal representing detection of the replacement of the cartridge. At the same time, by driving the recording head after lapse of a predetermined time duration subsequent to the start of purge, it is possible to effectively remove from the recording head the bubbles occurring due to cartridge replacement and attached to the passage walls and foreign objects produced by the replaced cartridge.

In the ink jet recorder in accordance with the present invention, when a purging operation is performed a plurality of times, the actuator can be controlled such that the operation of the actuator in an initial purge is effected more intensely than the operation of the actuator in an ensuing purge. As a result, it becomes possible to effectively remove the bubbles and foreign objects attached to the wall surfaces of the ink passage by the operation of the actuator in the initial purge, and to remove the bubbles and foreign objects without producing bubbles through the operation of the actuator in the ensuing purge. To control the actuator such that the operation of the actuator in the initial purge is effected more intensely than the operation of the actuator in the ensuing purge, for instance, the number of times the actuator is driven in the initial purge may be more numerous than the number of times the actuator is driven in the ensuing purge. Further, the driving frequency of the actuator in the initial purge may be higher than the driving frequency of the actuator in the ensuing purge. Furthermore, in terms of a change in the volume of the ink passage due to the actuator, the change in the volume in the initial purge may be greater than the change in the volume in the ensuing purge.

Still further, of the plurality of times of purge, the actuator may be operated during an initial predetermined number of purges. For instance, the operation of the actuator may be omitted in a final purge. As a result, in the final purge, the occurrence of bubbles due to the operation of the actuator can be avoided. The actuator is formed of a piezoelectric material. That is, the present invention can be applied to various recording apparatuses such as an ink jet printer and facsimile equipment using a piezoelectric material in the recording head.

In accordance with a second aspect of the present invention, there is provided an ink jet recorder comprising: a recording head having an ink passage, a nozzle connected thereto, and an actuator for ejecting ink from the nozzle by changing a volume of the ink passage; an ink cartridge for supplying the ink to the recording head; a purging device for covering the nozzle and sucking the ink inside the recording head; and a control unit for controlling the purging device so as to effect a first purge and a second purge having a greater sucking force than that in the first purge, and for controlling the actuator so as to be operated during at least the first purging operation.

In the ink jet recorder of the type in which the ink cartridge is replaced, air is present in the ink passage from the ink cartridge to the recording head due to replacement of the ink cartridge. In the ink jet recorder in accordance with the second aspect of the present invention, ink is introduced from the ink cartridge into the recording head while suppressing bubbling in the first purging operation in which the sucking force is relatively small. Namely, it is desired that the first sucking force be sufficient to draw out the ink up to the nozzle. The ink passage and the nozzle are filled with the ink by the first purging operation. At this juncture, the ink passage walls and the ink are vibrated by driving the actuator of the recording head, and by virtue of a synergistic effect with the flow of ink flowing at a low velocity inside the ink passage due to the first purging operation, the bubbles and foreign objects attached to the passage walls are easily separated from the walls. Thus, the separated bubbles and foreign objects are discharged from the recording head together with the ink by the first purging operation and/or the second purging operation. On the other hand, during the second purging operation, since the recording head is filled with the ink, the purge can be effected with a stronger sucking force than during the first purging operation. It should be noted that the operation of the actuator may be effected during the first purging operation only, or may be effected during both the first purging operation and the second purging operation.

The ink jet recorder in accordance with the second aspect of the invention may further comprise: a sensor for detecting replacement of the ink cartridge, wherein the control unit operates the purging device and the actuator in response to a signal representing detection of the replacement of the ink cartridge by the sensor. The bubbles in the ink passage are liable to occur particularly due to the replacement of the ink cartridge. Accordingly, in the ink jet recorder of the type in which the ink cartridge is replaced, if the replacement of the ink cartridge is automatically detected by the sensor, the first and second purges are executed on the basis of the signal representing detection of the cartridge replacement, and the actuator of the recording head is driven at least during the first purging operation, thereby making it possible to effectively remove from the recording head the bubbles attached to the passage walls and foreign objects produced by the replaced cartridge.

The ink jet recorder may further comprise: a filter provided at a connecting portion between the ink cartridge and the recording head, wherein the sucking force in the first purge is sufficient for allowing the ink to pass through the filter. As a result, it is possible to suppress bubbling when the ink passes through the filter.

Further, the recording head may be provided with a connecting pipe for communicating with the ink cartridge, the ink cartridge may be mounted so as to be detachable with respect to the connecting pipe, and the filter may be provided in the connecting pipe. As a result, it is possible to prevent the foreign objects produced by ink cartridge replacement from entering the connecting pipe. Further, the recording head may be provided with an ink supply hole formed in a portion of the ink cartridge for connection to the connecting pipe, and the filter may be disposed in the ink supply hole. As a result, when the ink cartridge is replaced, it is possible to prevent the ink from dripping from the ink cartridge.

In the ink jet recorder in accordance with the present invention, the purging device includes a suction cap for covering the nozzle and a suction pump for sucking the ink inside the recording head through the suction cap. The present invention is particularly effective if it is applied to an ink jet printer in which the ink cartridge is replaceable.

DESCRIPTION OF THE PREFERRED EMBODIMENTS

Referring now to the accompanying drawings, a description will be given of specific examples of an ink jet recorder in accordance with the present invention, but the present invention is not limited to the same.

First Embodiment

First, referring to FIG. 1, a description will be given of a specific structure of the ink cartridge in accordance with the present invention.

Figure 1:
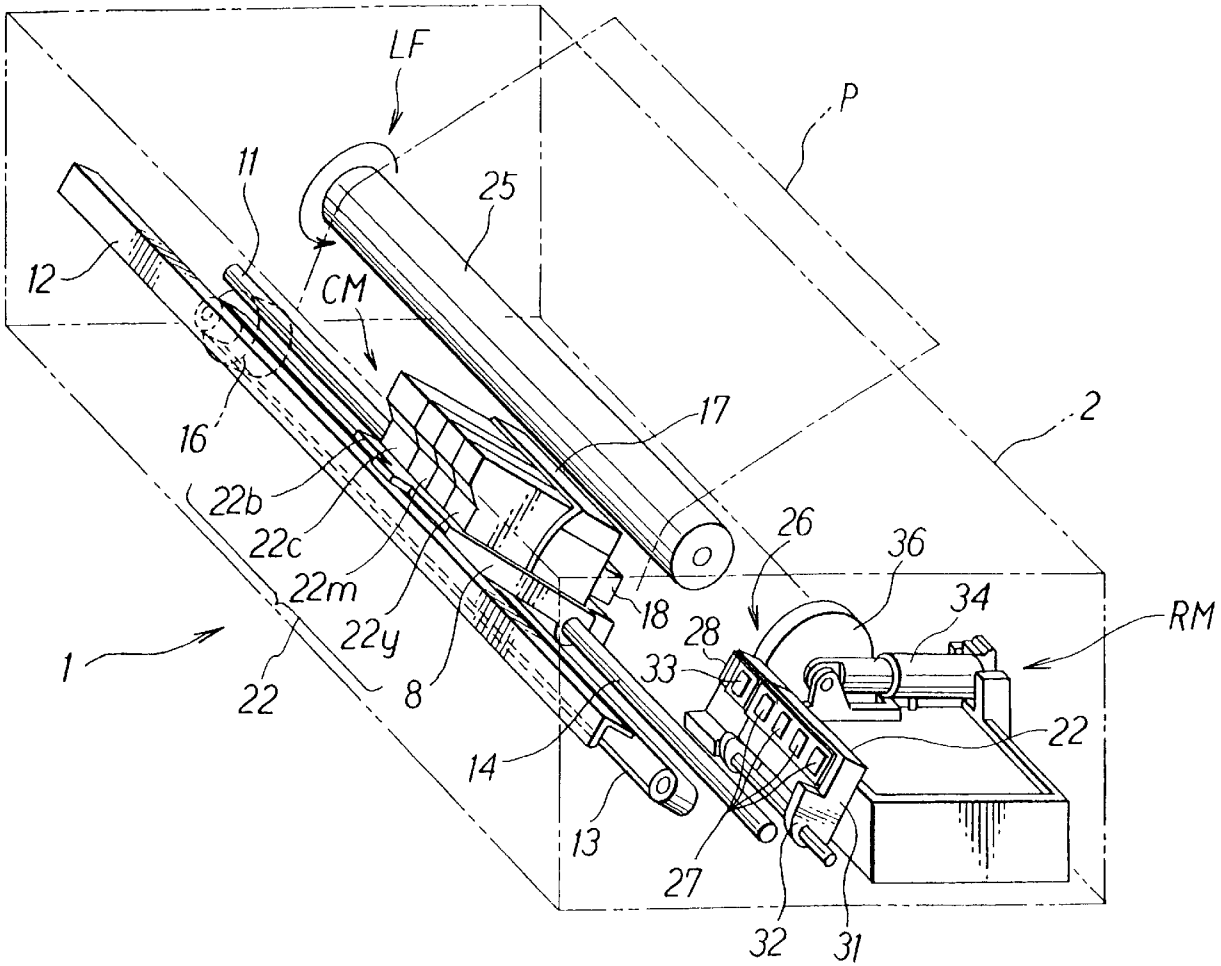
FIG. 1 is a perspective view schematically illustrating a specific example of an ink jet printer in accordance with the present invention.

As shown in FIG. 1, a carriage 8 is slidably supported by a guide rod 11 and a guide member 12, respectively, is secured to a belt 13, and is driven and reciprocated by a CR motor 16.

Figure 2:
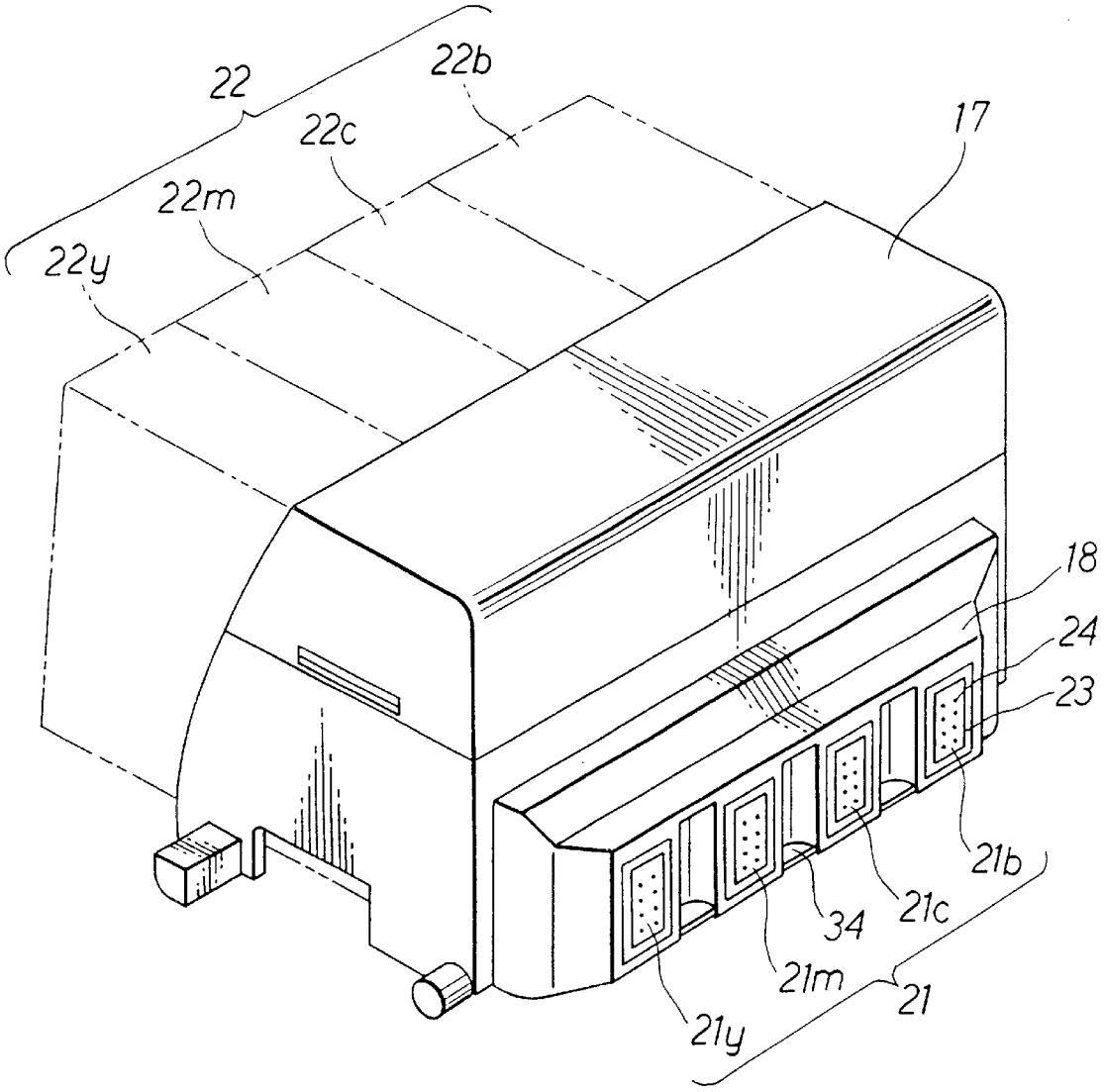
FIG. 2 is an enlarged perspective view of a print head unit of the ink jet printer shown in FIG. 1.

A recording head unit 17 having a recording head 18 to effect recording such as printing is mounted on the carriage 8. This recording head unit 17 is of an ink jet type in which a recording operation is effected by discharging droplets of four colors of ink (cyan c, magenta m, yellow y, and black b) onto recording paper P which is a recording medium. As shown in FIG. 2, the recording head 18 provided on its recording side has four ejection nozzles 21*y*, 21*m*, 21*c*, and 21*b* (which will be generally designated as 21) to eject ink of the respective colors.

Further, four ink cartridges 22*y*, 22*m*, 22*c*, and 22*b* (which will be generally designated as 22) for supplying the ink of the respective colors to the respective ejection nozzles 21 are detachably mounted on a rear portion (on the left-hand side in FIG. 2) of the recording head unit 17.

The ejection nozzles 21 are actuators formed by piezoelectric elements for ejecting ink, and a multiplicity of recessed portions are cut in a material of each piezoelectric element in parallel with each other in linear form, thereby forming a multiplicity of (e.g., 64) channels (not shown) serving as flow passages for the ink. These channels are open at nozzle faces 23, thereby forming a multiplicity of ejection holes 24.

Accordingly, as a voltage of a predetermined frequency is applied to the piezoelectric element serving as an actuator located at the position for constituting wall surfaces of the respective channel, ink can be ejected from a desired ejection hole 24. In particular, in this embodiment, during a purging operation, the operation of removing bubbles, dust, and the like can also be effected by vibrating the wall surfaces of each channel by applying a voltage to the piezoelectric element corresponding to a predetermined ejection nozzle 21, as will be described later.

Figure 3:
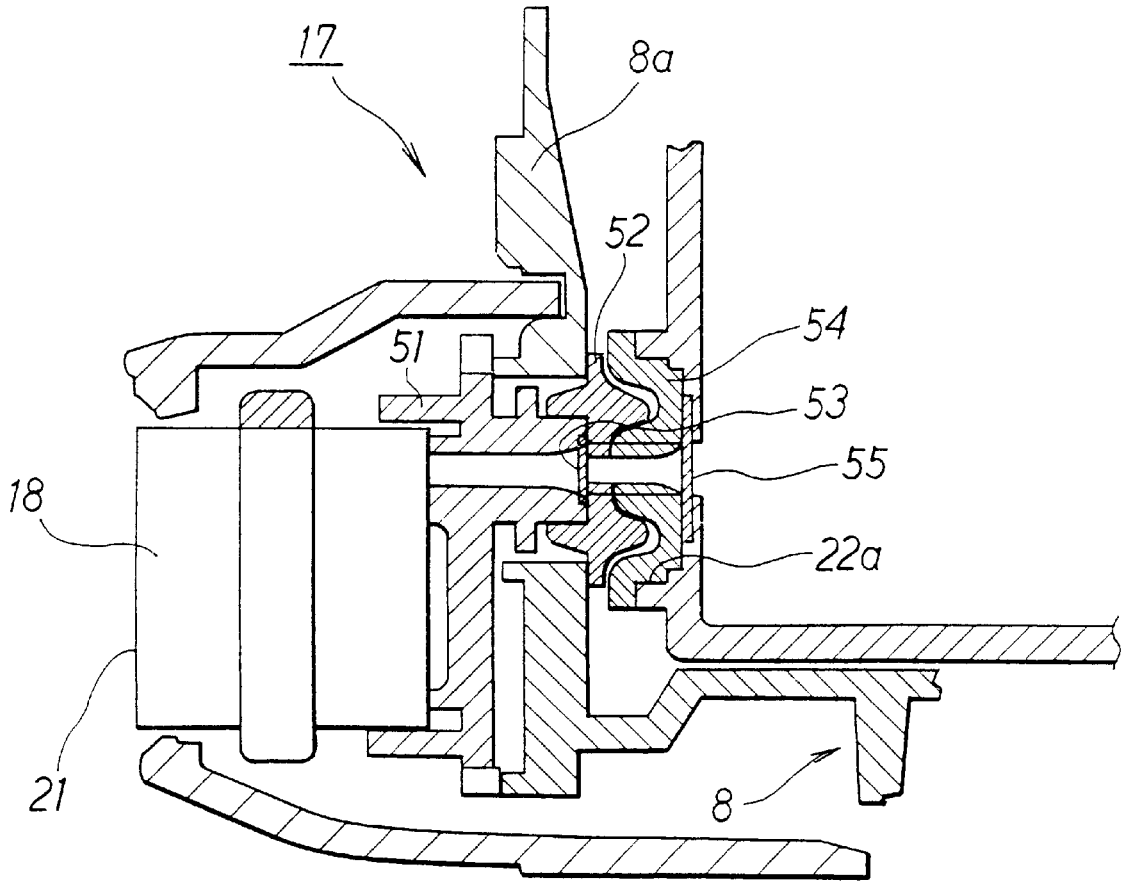
FIG. 3 is an enlarged cross-sectional view of a connecting portion between the print head and an ink cartridge in the print head unit of the ink jet printer shown in FIG. 1.

As shown in FIG. 3, a connecting pipeline portion between the print head 18 and the ink cartridge 22 is formed by a manifold member 51 for distributing ink to the ejection nozzles 21 of the print head 18 as well as a joint member 52. Further, the connecting pipeline portion between the print head 18 and the ink cartridge 22 extends through a vertical wall portion 8*a* of the carriage 8, and one end of the joint member 52 is connected to an ink supply hole 22*a* in the ink cartridge 22.

A mesh-like filter member 53 is provided at a joint portion between the manifold member 51 and the joint member 52. In addition, a mesh-like filter member 55 is pressed against and secured to the ink supply hole 22*a* of the ink cartridge 22 by an adapter 54. The filter member 53 prevents foreign objects such as dust from entering the print head 18 before the ink cartridge 22 is connected to the joint member 52. Meanwhile, by means of the surface tension of the ink at the filter member 55, the filter member 55 prevents the ink from dripping from the ink supply hole 22*a* of the ink cartridge 22 when the ink cartridge 22 is connected to the joint member 52.

As shown in FIG. 1, a transporting mechanism LF for transporting printing paper P is disposed at a position opposing the print head 18. The transporting mechanism LF transports the printing paper P by the rotation of a platen roller 25 which is rotated by the driving of an LF motor 106 (see FIG. 6). The platen roller 25 is rotatably supported by a printer frame 2.

A maintaining/recovering mechanism RM for maintaining and recovering the ink ejecting operation of the recording head 18 is provided on a side of the transporting mechanism LF. The maintaining/recovering mechanism RM includes: a suction mechanism 26 for overcoming faulty ejection occurring due to such as the drying of the ink during the use of the recording head 18, the occurrence of bubbles inside the recording head 18, and the attachment of ink droplets to the nozzle faces 23; a preserving cap 27 for preventing the drying of the ink by covering the nozzle faces 23 when an ink jet printer 1 is not in use; and a wiper member 28 for wiping off the nozzle faces 23.

Figure 4:
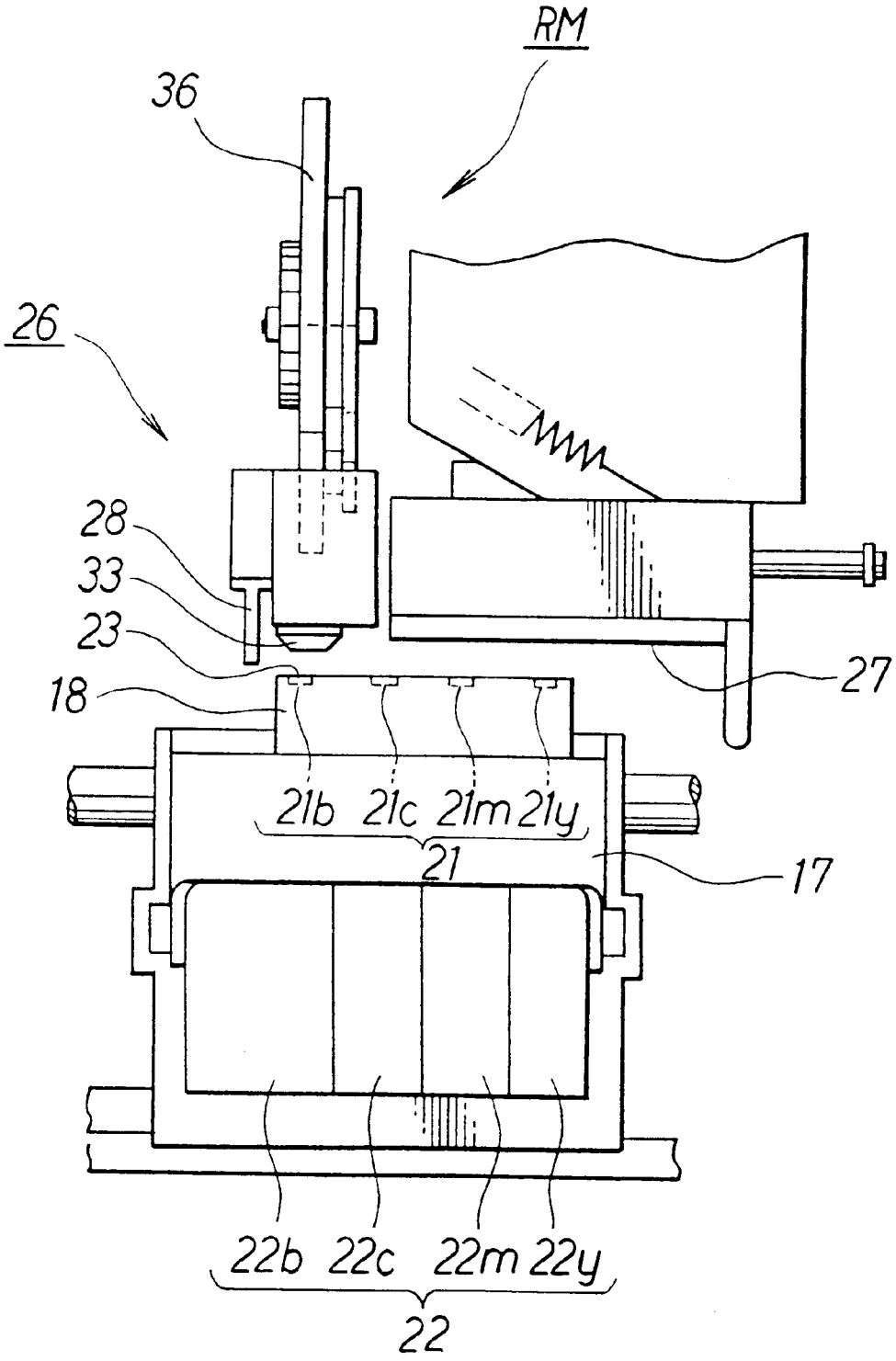
FIG. 4 is a partial plan view illustrating the print head unit and a maintaining/recovering mechanism RM of the ink jet printer shown in FIG. 1.

As shown in FIG. 4, the suction mechanism 26 includes a suction cap 33 which is capable of being brought into close contact with or moving away from the face 23 of each ejection nozzle 21 of the recording head 18, as well as a suction pump 34 (see FIG. 1) for sucking the ink through the suction cap 33 when the suction cap 33 is in close contact with the recording head 18. The suction mechanism 26 causes the suction cap 33 and the wiper member 28 to be advanced and retracted with respect to the recording head 18 by means of a cam member 36 and a cam driving motor 107 (see FIG. 6), and effects a suction operation (purging operation) through the cap 33 by driving the suction pump 34.

Figure 5A:
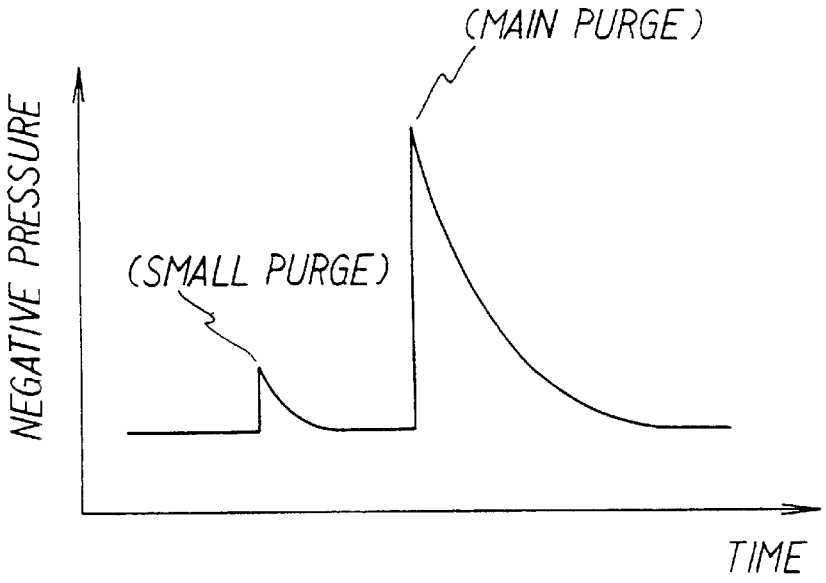
FIG. 5A is a graph illustrating the magnitude of negative pressure during a purging operation consisting of a small purge and a large purge.

Specifically, a suction operation such as the one shown in FIG. 5A is effected by one reciprocating motion of the suction pump 34. For example, when one purging operation is effected for a certain ejection nozzle 21, a small purge is initially executed under a small negative pressure, and a full-scale purge is then executed under a large negative pressure (the purge by one reciprocating motion of the suction pump 34 will be referred to as one cycle of purge). It should be noted that in a case where a plurality of times of purge are effected, the small purge is not effected starting with a second purge and thereafter. For example, starting with the second purge and thereafter, by rotating the cam member 36 at a high speed at a position corresponding to the small purge, the small purge can be passed, and can be substantially omitted.

Figure 5B:
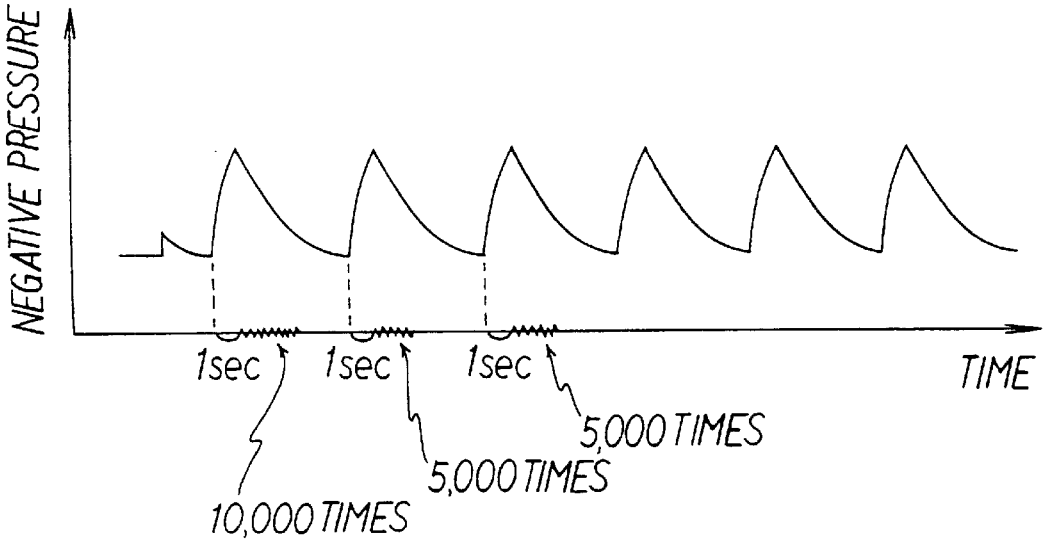
FIG. 5B is a graph illustrating purges in a plurality of purging operations, timings at which an actuator is operated, the number of times the actuator is operated.

In particular, in this embodiment, in a case where a plurality of times of purge are effected with respect to one ejection nozzle 21, the ejection nozzle 21 is driven as shown in FIG. 5B. Namely, in a case where six full-scale purges are effected, about 10,000 vibrations are generated in an initial full-scale purge by applying a voltage of 10.8 kHz to the piezoelectric element, about 5,000 vibrations are generated in second and third full-scale purges, and vibrations are not generated in fourth to sixth full-scale purges by prohibiting the application of voltage to the piezoelectric element. Incidentally, the timing of application of the voltage to the piezoelectric element in the first to third full-scale purges is set to one second after the starting of the full-scale purge.

Figure 6:
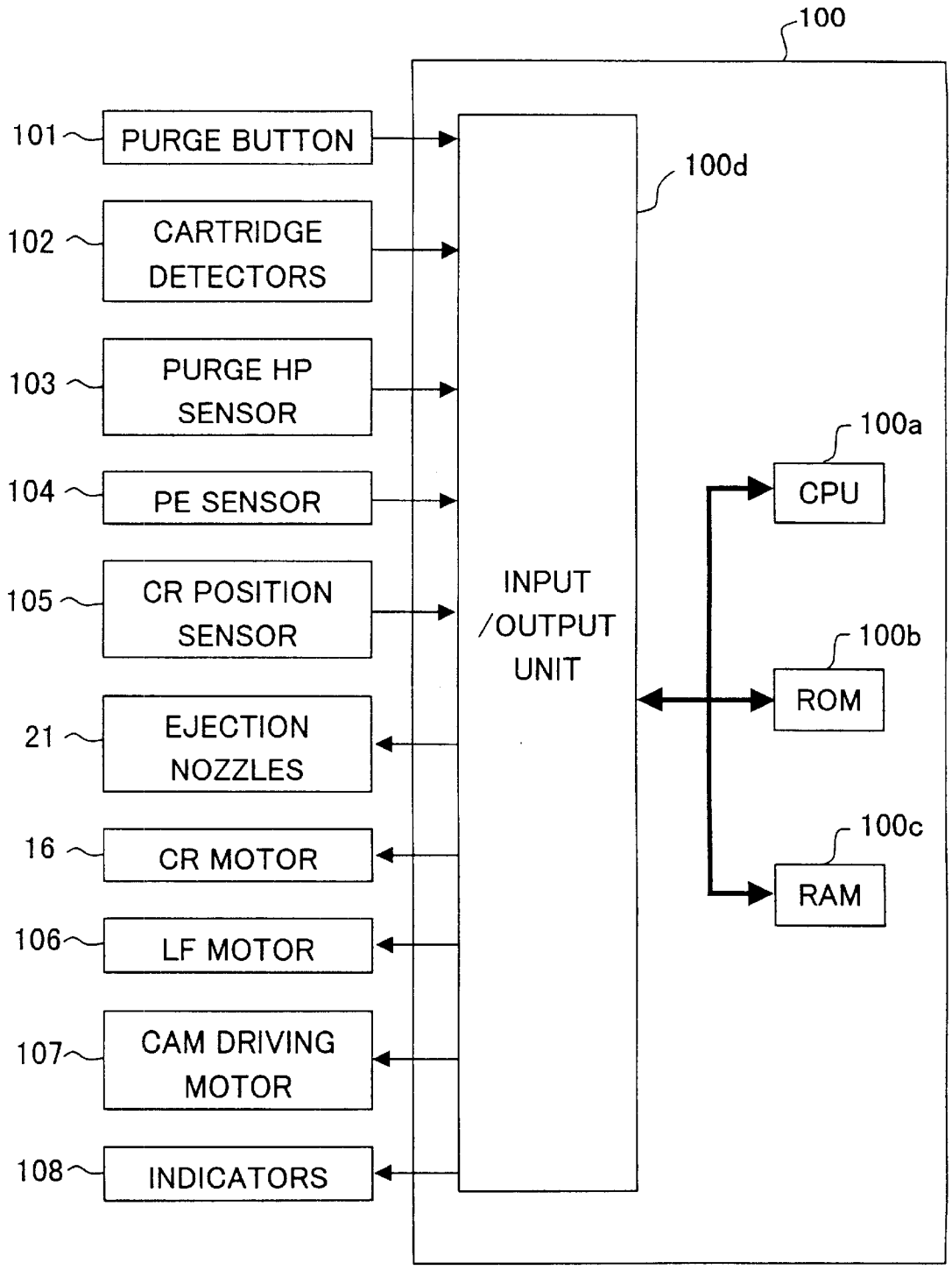
FIG. 6 is a block diagram illustrating an electrical configuration in a specific example of the ink jet printer in accordance with the present invention.

Next, with reference to FIG. 6, a description will be given of an electrical configuration of the ink jet printer 1 in accordance with this embodiment.

A an execution control unit (ECU) 100 of the ink jet printer 1 is comprised of a known microcomputer having a CPU 100*a,* a ROM 100*b,* a RAM 100*c,* and an input/output unit 100*d.*

Connected to the input/output unit 100*d* are, among others, switches including a purge button 101 for designating a suction operation by the suction mechanism 26; a cartridge detector 102 for detecting whether the ink cartridges 22 has been loaded or not; a purge HP sensor 103 for detecting that the suction pump 34 is at its original position; a PE sensor 104 for detecting a leading end of the recording paper P; a CR position sensor 105 for detecting the position of the carriage 8; the ejection nozzles 21, i.e., actuators for effecting the ejecting operation; the CR motor 16 for moving the carriage 8; the LF motor 106 for driving the transporting mechanism LF; the cam driving motor 107 for driving the cam member 36 for driving the suction mechanism 26; and indicators 108 for displaying the present state of operation and the like.

Next, referring to the flowchart shown in FIG. 7, a description will be given of control processing of the ink jet printer 1 in accordance with this embodiment. Here, a description will be given of the purge during initial introduction of ink (initial purge) which is effected after replacement of the cartridge 22.

Figure 7:
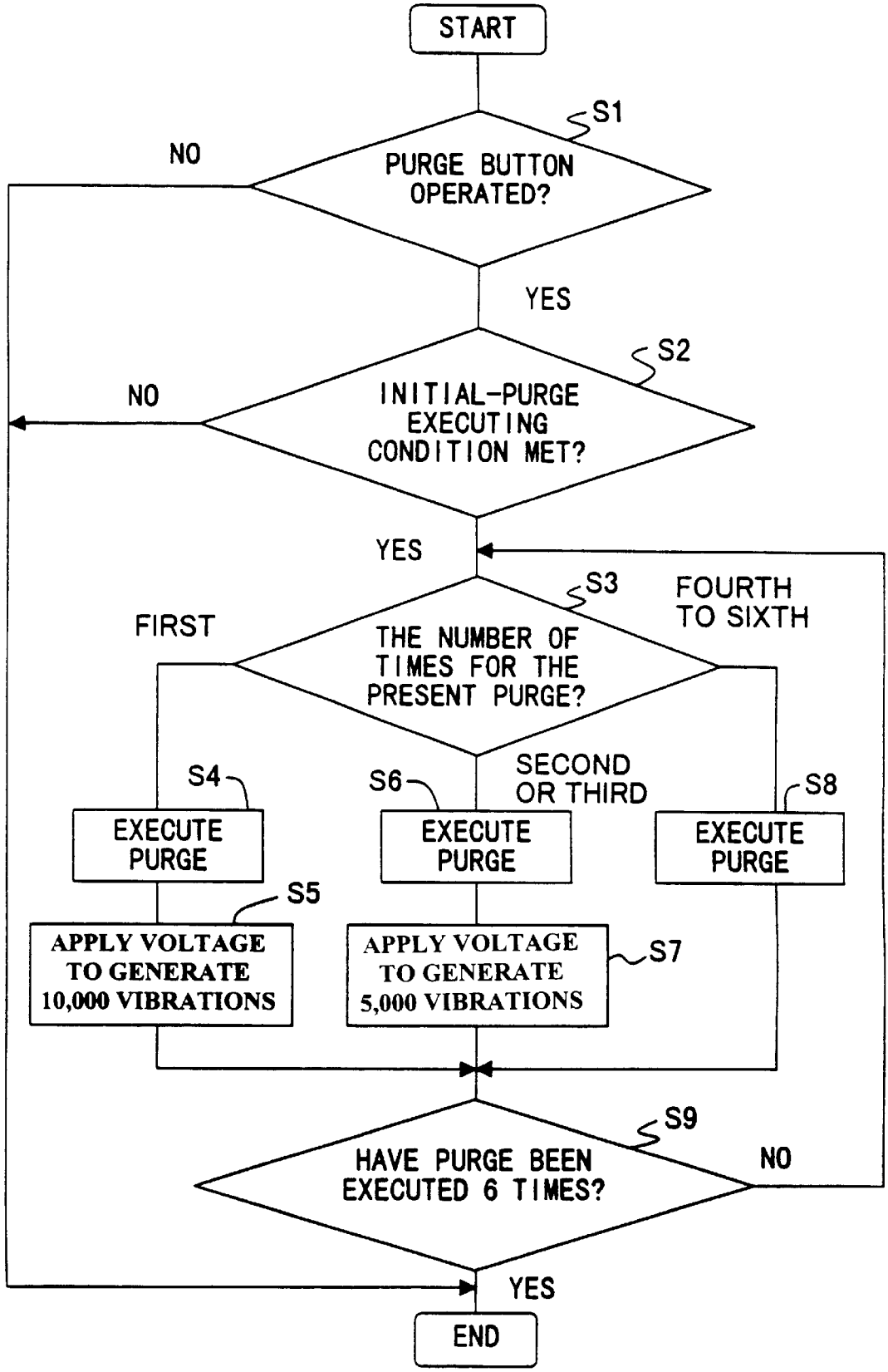
FIG. 7 is a flowchart illustrating the contents of control of the purging operation in accordance with a first embodiment of the present invention.

As shown in FIG. 7, a determination is made as to whether or not the purge button 101 has been operated (S1), and if it has been operated (S1: YES), and a determination is made as to whether or not a condition of execution of the initial purge has been met, e.g., whether or not the removal and reloading of the cartridge 22 has been detected by the cartridge detector 102 (S2).

Here, if the condition of execution of the initial purge has been met (SE: YES), a determination is made on the frequency (the number of times) of the purge to be executed this time (S3).

If the purge to be executed this time is determined to be the first purge, a purging operation including a small purge and a full-scale purge is executed (S4). Subsequently, after waiting one second subsequent to the start of the full-scale purge, a voltage with 10.8 kHz is applied to the piezoelectric element to generate about 10,000 vibrations (S5).

Then, a determination is made as to whether or not the purge has been executed six times (S9), and if the purge has not been executed six times (S9: NO), the operation returns to step S3 to determine the number of times of purge, and the purge is executed again. On the other hand, if the purge has already been executed six times (S9: YES), it is regarded that the initial purge has been completed, so that this processing temporarily ends.

In addition, if it is determined in step S3 that the purge which is to be executed this time is the second or third purge, a purging operation in which a small purge is omitted is executed (S6). Subsequently, after waiting one second subsequent to the start of the purge, a voltage is applied to the piezoelectric element to generate about 5,000 vibrations (S7), and a determination is similarly made as to whether or not the purge has been executed six times (S9).

Furthermore, if it is determined in step S3 that the purge which is to be executed this time is one of the fourth to sixth purges, a purging operation in which a small purge is omitted is executed (S6). At this time, however, the piezoelectric element is not driven, a determination is similarly made as to whether or not the purge has been executed six times (S9), and this processing temporarily ends.

In addition, if the purge has not been executed six times (S9: NO), the purge is executed again. On the other hand, if the purge has been executed six times (S9: YES), it is regarded that the initial purge has been completed, so that this processing temporarily ends.

Thus, in this embodiment, since in a case where a plurality of purging operations are performed with respect to the ejection nozzles 21, the piezoelectric element, i.e., the actuator, is actuated during the execution of the purging operation to vibrate the wall surfaces of the ink channel, bubbles and dust attached to the wall surfaces can be removed and effectively discharged outside the ejection nozzle 21 directly by the vibrations or by cavitation based on the vibrations. For this reason, an outstanding advantage is offered in that the recording quality (printing quality) improves.

In addition, since the timing of operation of the actuator is set to one second after the starting of the purge, the actuator is operated after the ink has actually started to flow out, so that the capability of removing bubbles and dust excels.

Furthermore, since the state of subsequent (second and third) operation (in this case, the number of vibrations) of the actuator is suppressed to a lower level than the state of operation of the actuator in the initial (first) purging operation, bubbles which remain in the ink are reduced as a result. In other words, although the bubbles and dust on the wall surfaces can be removed by the operation of the actuator, there are cases where bubbles are produced to the contrary. Hence, by reducing the operation of the actuator close to the recording timing, it is possible to reduce the bubbles and further improve the recording quality.

In particular, since the operation of the actuator immediately before recording, i.e., in a final purge, is prohibited, it is possible to prevent the occurrence of bubbles more reliably and further improve the recording quality.

Second Embodiment

Next, a description will be given of a second embodiment.

Since the configuration of hardware of this embodiment is similar to that of the above-described first embodiment, a description will be given of control processing.

Referring to the flowcharts shown in FIGS. 8 and 9, a description will be given of purge for preventing the drying of ink (recovery purge) which is effected after the start of using the ink jet printer.

It should be noted that although this recovery purge is effected manually or automatically, a description will be given herein of an example in which the recovery purge is effected automatically.

Figure 8:
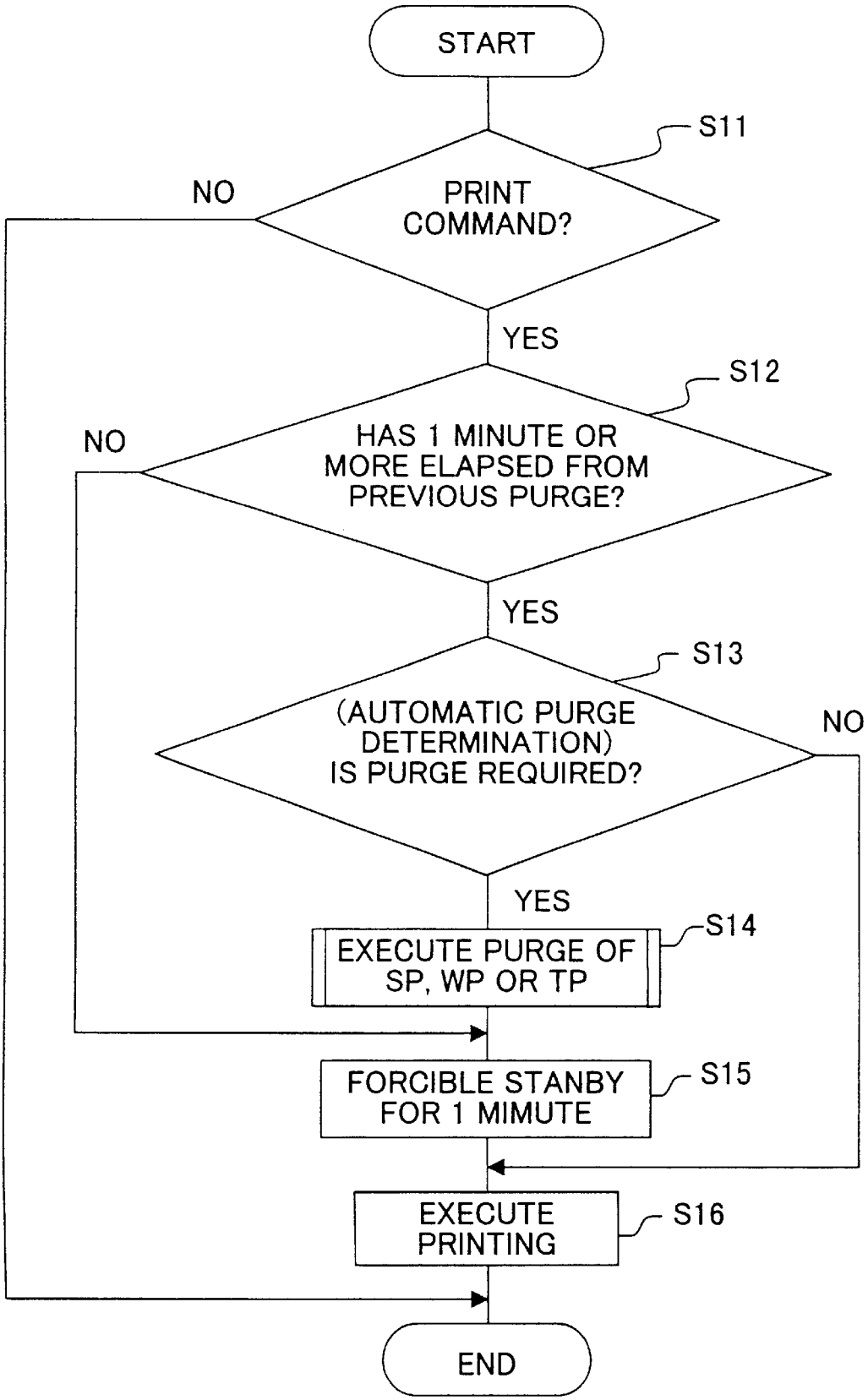
FIG. 8 is a flowchart concerning the purging operation in accordance with a second embodiment of the present invention.

As shown in FIG. 8, a determination is made as to whether or not a recording command (print command) has been inputted (S11), and if it is determined that the recording command has been inputted (S11: YES), a determination is made as to whether or not one minute or more has elapsed from the previous purge (S12).

Here, if it is determined that one minute or more has not elapsed from the previous purge (S12: NO), after prohibiting the recording operation for one minute (S15), the ink is ejected from the ejection nozzle 21 to execute recording (printing) (S16), and this processing temporarily ends.

On the other hand, if it is determined that one minute or more has elapsed from the previous purge (S12: YES), a determination on automatic purge is made (S12). In this determination on automatic purge, how many cycles of purge are to be effected with respect to the ejection nozzle 21 which effects the purge is determined on the basis of such as the unused period of the apparatus after execution of the previous purge (e.g., the number of days). For example, if the unused period is short, one cycle of purge (single purge SP) is performed, and the longer the unused period, the more the number of cycles of purge is increased in the manner of two cycles of purge (double purge) and three cycles of purge (triple purge).

Then, if it is determined in the determination on automatic purge that not a period has elapsed after execution of the previous purge, and that the purge is unnecessary (S13: NO), recording is executed as it is (S16), and this processing temporarily ends.

On the other hand, if it is determined in the determination on automatic purge that a predetermined period or longer has elapsed after execution of the previous purge, and that the purge is therefore necessary (S13: YES), the purge is performed in the number of cycles which is determined in correspondence with the length of the elapsed period (S14).

Subsequently, after one minute of a forcible standby (S15), recording is executed (S16), and this processing temporarily ends.

Next, referring to the flowchart shown in FIG. 9, a description will be given of processing for executing the purge in the aforementioned step S14 by citing an example in which, for instance, three cycles of purge (TP) are effected for each color.

Figure 9:
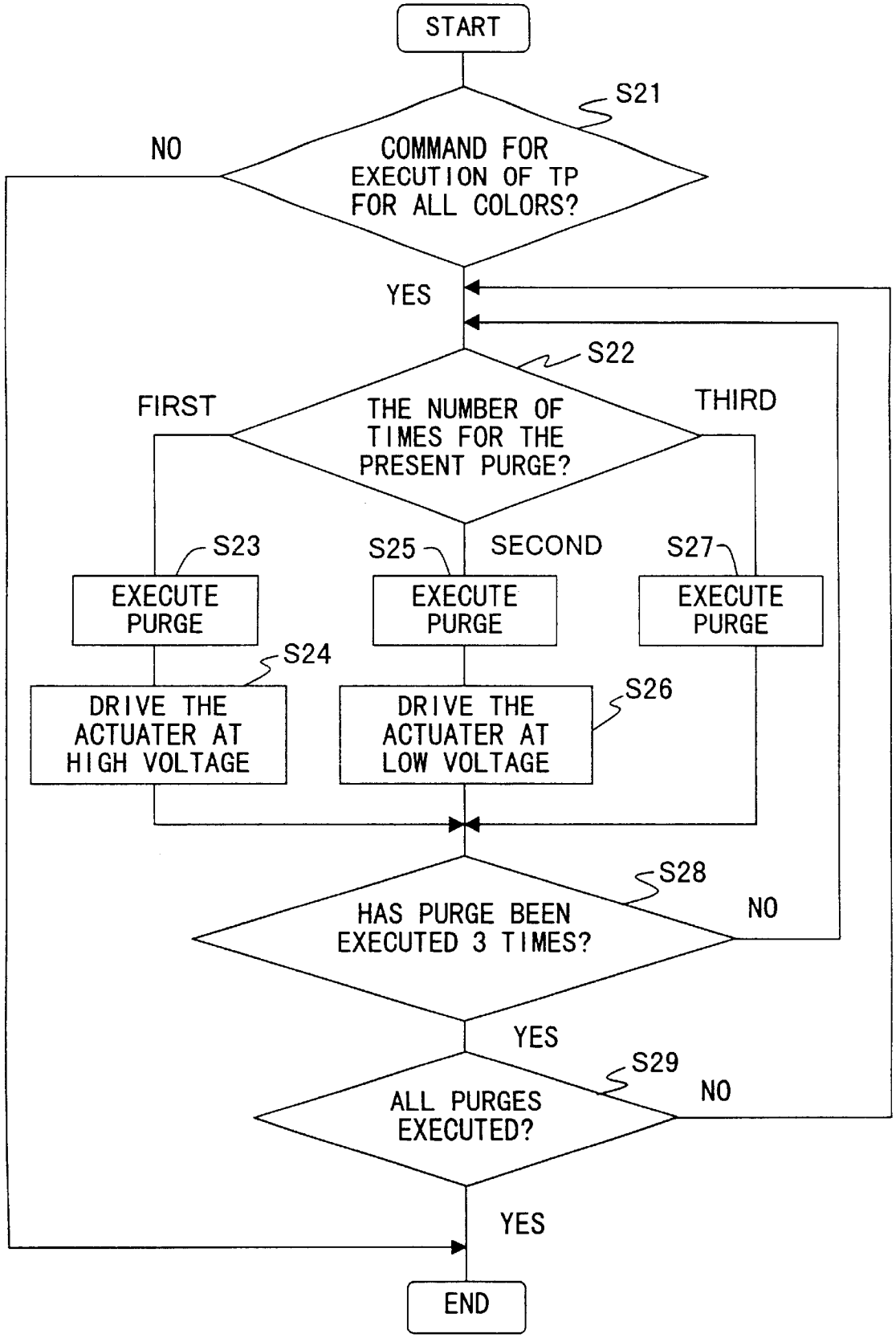
FIG. 9 is a flowchart illustrating the contents of control of the actuator accompanying the purging operation in accordance with the second embodiment of the present invention.

As shown in FIG. 9, a determination is made in the determination on automatic purge as to whether or not a command for three cycles of purge (TP) has been inputted (S21). If it is determined that the command for TP has not been inputted (S21: NO), this processing temporarily ends, and other processing is effected.

On the other hand, if it is determined that the command for TP has been inputted (S21: YES), a determination is made on the number of times of the purge which is to be effected this time to perform the purge for the ejection nozzles 21 corresponding to the respective colors (S22).

Then, if it is determined that the purge which is to be effected this time is the first purge, a purging operation including a small purge and a full-scale purge is executed (S23). Subsequently, after one second of standby subsequent to the start of the full-scale purge, a high voltage (e.g., 25V) is applied to the piezoelectric element to generate large vibrations at the wall surfaces (S24). Then, a determination is made as to whether or not the purge has been executed three times (S28), and if the purge has not been executed three times (S28: NO), the purge is executed again.

In addition, if it is determined in the aforementioned step S22 that the purge which is to be effected this time is the second purge, a purging operation in which a small purge is omitted is executed (S25). Subsequently, after one second of standby subsequent to the start of the purge, a low voltage (e.g., 20V) is applied to the piezoelectric element to generate small vibrations at the wall surfaces (S26). Then, a determination is similarly made as to whether or not the purge has been executed three times (S28).

Furthermore, if it is determined in the aforementioned step S22 that the purge which is to be effected this time is the third purge, a purging operation in which a small purge is omitted is executed (S27). At this time, however, the piezoelectric element is not driven, and a determination is similarly made as to whether or not the purge has been executed three times (S28).

Then, if the purge has been executed three times with respect to an ejection nozzle 21 corresponding to a certain color (S28: YES), a determination is made as to whether or not the purge has been executed three times for the ejection nozzles 21 corresponding to all the colors (S29). If the purge has not been executed three times for these ejection nozzles 21 (S29: NO), processing in the aforementioned steps S22 to S27 is repeated for the other colors. If the purge has been executed three times for these ejection nozzles 21 (S29: YES), it is regarded that the recovery purge has been completed, and this processing temporarily ends.

Thus, in this embodiment, in a case where a plurality of times of purging operation are effected with respect to the ejection nozzles 21, the state of operation of the actuator during the initial purge is made large, the state of operation of the actuator during an intermediate purge is lowered, and the operation of the actuator during a final purge is prohibited. Consequently, an advantage similar to that of the foregoing embodiment is offered.

In addition, after the determination in the aforementioned step S13 on whether or not the purge is required, in a case where one cycle of purge (SP) or two cycles of purge (WP) are to be effected, the actuator is not driven with respect to one cycle of purge (SP). In addition, although the actuator is driven with respect to the initial purge in the two cycles of purge (WP), the actuator is not driven with respect to the second purge.

Furthermore, in a case where a user has found a dropout of a dot and the like and attempts to effect a purge by operating a switch, such a purge is effected only once, so that the actuator is not driven during the purge. In this case, the purge may be effected a plurality of times.

The small purge in the aforementioned purging operation is mainly aimed at suppressing the bubbling which occurs when the ink begins to enter an empty passage, so that the small purge can be omitted depending on the form of the passage. In addition, at the time when, during the automatic purge in FIG. 7, the user effects a purge by operating the switch, as described above, since the passage is already filled with the ink, the small purge can be omitted even in the initial purge.

Third Embodiment

Next, referring to FIG. 10, a description will be given of another method of controlling the print head 18 and the maintaining/recovering mechanism RM by means of the ECU 100.

Figure 10:
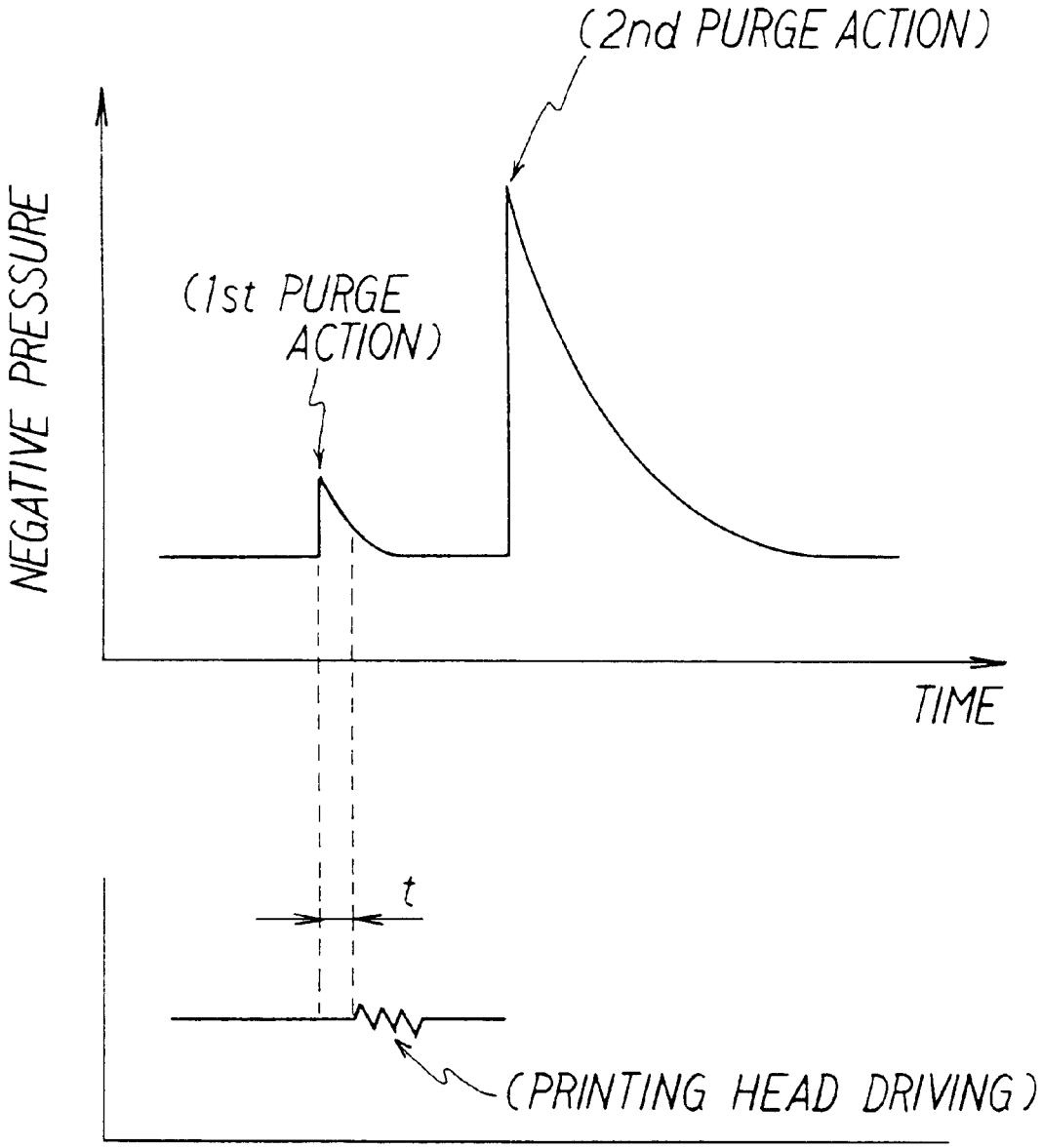
FIG. 10 is a graph illustrating the relationship between the first and second purging operations and timings at which the actuator is operated in accordance with a third embodiment of the present invention.
Figure 11:
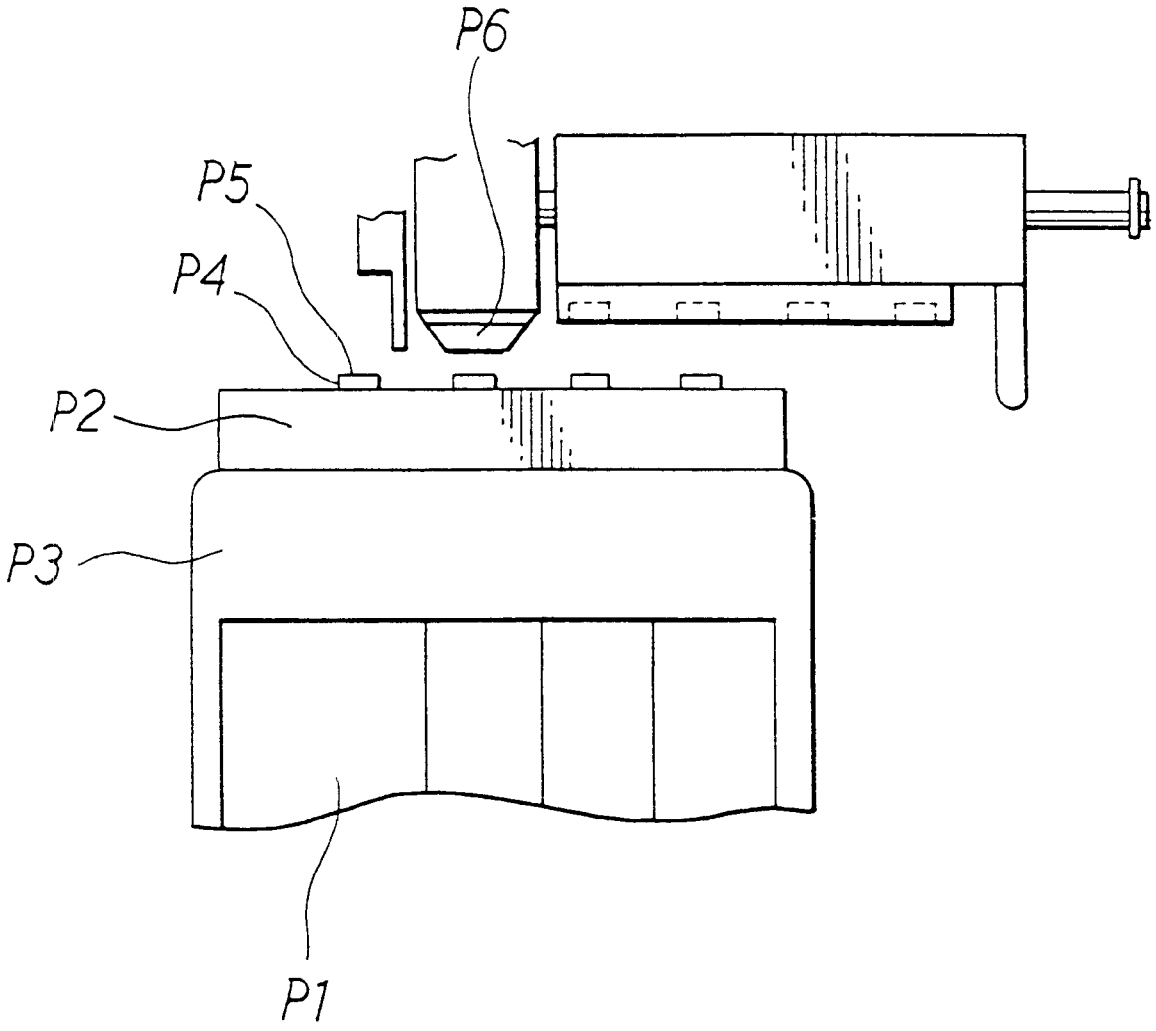
Fig. 11 PRIOR ART
FIG. 11 is a partial plan view of a conventional ink jet printer.

FIG. 10 is a graph illustrating a change in the negative pressure accompanying the purging operation in the ink passage from the ink cartridge 22 to the print head 18.

In the control of the driving of the suction pump 34 by the cam member 36, two purging operations (suction operations) with different sucking forces for sucking the ink from the print head 18 are effected. Namely, the purging operations effected by the suction pump 34 include a first purging operation in which the sucking force is small and a second purging operation in which the sucking force is greater and the suction period is longer than in the case of the first purging operation. The reason for the fact that two purging operations are thus performed is as follows.

When the ink passage is filled with the ink by performing a purging operation in a state in which air is present in the ink passage from the ink cartridge 22 to the ejection nozzle 21 of the print head 18, if the ink is abruptly sucked by applying a large negative pressure at a stroke, the ink and air become mixed and flow into the print head 18, so that bubbling occurs in the ink, and the bubbles are entrained in the ink inside the print head 18. In particular, in a case where the filter members 53 and 55 are provided in the connecting portion between the print head 18 and the ink cartridge 22, when the ink abruptly passes through the filter members 53 and 55, large-scale bubbling occurs, and bubbles are produced in a large amount.

Accordingly, in the aforementioned state in which air is present in the ink passage, the ink is absorbed into the print head 18 while suppressing the bubbling by the first purging operation in which the sucking force is small. Through this first purging operation, the ink passage is filled with the ink, and the ink reaches as far as the nozzle face 23 of the ejection nozzle 21 of the print head 18. Since there is no possibility of the occurrence of bubbling in such a state in which the ink passage is filled with the ink, the second purging operation in which the sucking force is large and the sucking period is long is effected following the first purging operation.

Incidentally, the state in which air is present in the ink passage occurs such as at a time when the user has loaded the ink cartridge 22 into a new ink jet printer 1 for the first time, at a time when the ink cartridge 22 has been replaced, and at a time when after making a misjudgment that ejection is impossible when the remaining amount of ink in the ink cartridge 22 has become small, the user has effected a purging operation to recover the ejecting function.

For example, when the ink cartridge 22 has been replaced, an inlet portion of the connecting pipeline, i.e., the space between the filter members 53 and 55, is filled with air. In this state, if the first purging operation is effected with a small sucking force, the ink inside the ink cartridge 22 passes through the filter member 53 at a low velocity together with the air between the filter members 53 and 55. At this time, part of the aforementioned air often remains attached to an upstream-side surface of the filter member 53 in the form of bubbles inside the ink. As the wall surfaces of the channels are vibrated by driving the print head 8 immediately after the ink has passed through the filter member 53, the vibrations cause the ink to vibrate, and allow the aforementioned bubbles to pass through the filter member 53 smoothly without causing large-scale bubbling. Additionally, very small dust and bubbles which are attached to the inner wall surfaces of the ink passage are also exfoliated smoothly and are easily removed without causing large-scale bubbling. In other words, the imparting of vibrations to the ink which flows at a low velocity facilitates the movement of the bubbles and dust together with the ink. For this reason, the bubbles and dust which have passed through the filter member 53 and have been exfoliated from the wall surfaces by the first purging operation are made to pass through the print head 18 by the ensuing second purging operation, and are sucked through the suction cap 33 and are removed from the ink passage and channels.

Here, the sucking force in the first purging operation is of such a measure that it destroys the surface tension of the meniscus which is formed on the filter member by the ink, i.e., the sucking force is of a minimum magnitude for allowing the ink to pass through the filter member or of such a measure that it slightly exceeds that magnitude. For this reason, even if the print head 18 is driven in synchronism with the sucking of the ink, the ink passing through the filter members 53 and 55 does not bubble. Accordingly, in the first purging operation, it becomes possible to reliably remove the bubbles and dust which remained in the ink passage, without causing the bubbling of the ink, thereby making it possible to prevent the faulty ejection of the ink.

Then, during the second purging operation as well, the print head 18 is driven in the same way as during the first purging operation. Here, since the ink passage is filled with the ink by the first purging operation, even if the print head 18 is driven in synchronism with the sucking of the ink with a large sucking force during the second purging operation, the ink which passes through the filter members 53 and 55 is prevented from bubbling. Consequently, in the second purging operation, it becomes possible to completely remove the bubbles and dust which could not be removed in the first purging operation and remained in the ink passage, thereby making it possible to reliably prevent the faulty ejection of the ink.

In the replacement of the ink cartridge 22, as the print head 18 is driven by slightly lagging behind the start of the first purging operation (by the time t in FIG. 10) to such an extent that new ink is made to reach the residual ink inside the manifold member 51 by the first purging operation, it is possible to transmit the vibrations of the wall surfaces of the channels to the position of the filter member 53 by means of the ink. Additionally, the duration of the first purging operation may be of such a measure that a predetermined amount of ink is drawn toward the print head 18 or flows into the channels in the print head 18 after the transmission of the vibrations in the above-described manner.

As described above in detail, in accordance with the ink jet printer 1 in this embodiment, the first purging operation based on a sucking force necessary for the passage through the filter members 53 and 55 as well as the subsequent second purging operation in which the sucking force is greater than that for the first purging operation are carried out. Then, the print head 18 is driven during the first and second purging operations. Consequently, even if air is present in the ink passage, it becomes possible to introduce the ink to the print head 18 while suppressing the bubbling of the ink, and it becomes possible to effect normal high-quality printing while preventing the faulty ejection of the ink.

Although, in the above-described embodiment, the print head 18 is driven during the second purging operation as well, the print head 18 may be driven during the first purging operation only, and the driving of the print head 18 may be stopped during the second purging operation. In this case, the effect of removal of bubbles and dust from the ink passage during the second purging operation declines slightly, but the effect of suppressing the bubbling of the ink can be obtained in the same way as the above-described embodiment, and it becomes possible to effect normal high-quality printing while preventing the faulty ejection of the ink.

It should be noted that the present invention is not limited to the above-described embodiments, and it goes without saying that the present invention can be implemented in various forms without departing from the gist of the embodiments.

For example, although, in the first to third embodiments, a description has been given of the ink jet printer, the present invention can be applied to various other recording apparatuses such as facsimile apparatus.

In addition, although, in the first and second embodiments, a description has been given of the example in which purges are effected continuously with respect to a certain ejection nozzle, the present invention can also be applied to an example in which one full-scale purge is effected consecutively with respect to all the ejection nozzles corresponding to the plurality of colors, and similar purges are repeatedly effected with respect to all the colors. In this case, although a longer duration is required between the purges than in the case of the aforementioned embodiments in terms of a certain ejection nozzle, but there is a sufficient effect of removing the bubbles and dust attached to the wall surfaces of the ink passages.

Although, in the first and second embodiments, a description has been given of the number of vibrations occurring in the piezoelectric element and a voltage applied thereto as an example of adjusting the state of operation of the actuator, an arrangement may be alternatively provided such that the later the purge, the more the frequency of the voltage applied to the piezoelectric element is reduced.

In the third embodiment as well, in the same way as in the first embodiment, the purging operation, particularly the first purging operation, may be executed in response to a detection signal from the detector 102 representing the replacement of the ink cartridge, and the timing of operation of the actuator during the first purging operation may be effected by using that detection signal as a reference. Further, in the third embodiment as well, in the same way as in the first embodiment, printing by the print head may be allowed only after the lapse of a predetermined duration, e.g., one minute, subsequent to the purging operation.

As for the print heads, it is possible to use actuators of various structures, and the print heads disclosed in, for example, U.S. Pat. Nos. 5,410,341 and 5,502,472 can be used in the present invention. The disclosure of these United States patents is herein incorporated into by reference.

What is claimed is:

1. An ink jet recorder, comprising:

a recording head having an ink passage, a nozzle connected thereto, and an actuator for ejecting ink from the nozzle by changing a volume of the ink passage;

a purging device for performing a plurality of times of purging operations by covering the nozzle and sucking the ink inside the recording head; and a control unit for controlling the actuator such that the actuator is operated after a lapse of a predetermined time duration from a start of the sucking by the purging device during an initial predetermined number of times of the purging operations, and is operated when the ink flows in the recording head by the sucking.

2. The ink jet recorder according to claim 1, wherein the predetermined time duration is at least as long as a time from the start of purge until a flow of the ink inside the ink passage is started.

3. The ink jet recorder according to claim 1, further comprising:

an ink cartridge; and a sensor for detecting replacement of the ink cartridge, wherein the control unit operates the purging device in response to a signal representing detection of the replacement of the ink cartridge by the sensor, and operates the actuator after the lapse of a predetermined time duration from the start of purge by the purging device.

4. The ink jet recorder according to claim 1, wherein the control unit allows recording by the recording head after the lapse of a predetermined time duration subsequent to the plurality of times of purging operations.

5. The ink jet recorder according to claim 1, wherein the number of times the actuator is vibrated in an initial purging operation is more numerous than the number of times the actuator is vibrated in an ensuing purging operation.

6. The ink jet recorder according to claim 1, wherein a driving frequency of the actuator in an initial purging operation is higher than a driving frequency of the actuator in an ensuing purging operation.

7. The ink jet recorder according to claim 1, wherein, in terms of a change in the volume of the ink passage due to the actuator, the change in the volume in the initial purge is greater than the change in the volume in the ensuing purge.

8. The ink jet recorder according to claim 1, wherein the actuator is formed of a piezoelectric material.

9. The ink jet recorder according to claim 7, wherein the operation of the actuator is omitted in a final purge.

10. An ink jet recorder, comprising:

a recording head having an ink passage, a nozzle connected thereto, and an actuator for ejecting ink from the nozzle by changing a volume of the ink passage;

an ink cartridge for supplying the ink to the recording head;

a purging device for performing a purging operation by covering the nozzle and sucking the ink inside the recording head; and a control unit for controlling the purging device so as to effect at least a first purging operation and a second purging operation, the second purging operation having a greater sucking force than that in the first purging operation, and for controlling the actuator so as to be operated during at least the first purging operation when the ink flows in the recording head by the sucking, wherein the actuator is operated after a lapse of predetermined time duration from a start of the sucking of the first purging operation by the purging device.

11. The ink jet recorder according to claim 10, wherein the control unit allows recording by the recording head after the lapse of a predetermined time duration subsequent to the second purging operation.

12. The ink jet recorder according to claim 10, further comprising:

a sensor for detecting replacement of the ink cartridge, wherein the control unit operates the purging device and the actuator in response to a signal representing detection of the replacement of the ink cartridge by the sensor.

13. The ink jet recorder according to claim 10, wherein the actuator is operated only during the first purging operation.

14. The ink jet recorder according to claim 10, further comprising:

a filter provided at a connecting portion between the ink cartridge and the recording head, wherein the sucking force in the first purging operation is sufficient for allowing the ink to pass through the filter.

15. The ink jet recorder according to claim 10, wherein the sucking force in the first purging operation is sufficient for allowing the ink to be drawn to the nozzle.

16. The ink jet recorder according to claim 10, wherein the purging device includes a suction cap for covering the nozzle and a suction pump for sucking the ink inside the recording head through the suction cap.

17. The ink jet recorder according to claim 14, further comprising:

a connecting pipe for communicating with the ink cartridge, the ink cartridge being mounted so as to be detachable with respect to the connecting pipe, the filter being provided in the connecting pipe.

18. The ink jet recorder according to claim 14, further comprising:

a connecting pipe for communicating with the ink cartridge, an ink supply hole being formed in a portion of the ink cartridge for connection to the connecting pipe, the filter being disposed in the ink supply hole.

19. The ink jet recorder according to claim 16, wherein the ink jet recorder is an ink jet printer.

20. An ink jet recorder, comprising:

a recording head having an ink passage, a nozzle connected thereto, and an actuator for ejecting ink from the nozzle by changing a volume of the ink passage;

a purging device for performing a plurality of times of purging operations by covering the nozzle and sucking the ink inside the recording head; and a control unit for controlling the actuator such that the actuator is operated after a lapse of a predetermined time duration from a start of the sucking by the purging device as part of the purging operation, and is operated when the ink flows in the recording head by the sucking, wherein a driving frequency of the actuator in an initial purging operation is higher than a driving frequency of the actuator in an ensuing purging operation.

21. The ink jet recorder according to claim 20, wherein the predetermined time duration is at least as long as a time from the start of the sucking until a flow of the ink inside the ink passage is started.

22. The ink jet recorder according to claim 20, further comprising:

an ink cartridge; and a sensor for detecting replacement of the ink cartridge, wherein the control unit operates the purging device in response to a signal representing detection of the replacement of the ink cartridge by the sensor, and operates the actuator after the lapse of a predetermined time duration from the start of the sucking by the purging device.

23. The ink jet recorder according to claim 20, wherein the number of times the actuator is vibrated in the initial purging operation is more numerous than the number of times the actuator is vibrated in the ensuing purging operation.

* * * * *